US011832691B2

(12) United States Patent
Haramein et al.

(10) Patent No.: US 11,832,691 B2
(45) Date of Patent: Dec. 5, 2023

(54) MODULAR FRAMES FOR GEOMETRIC SOLIDS

(71) Applicant: ARK CRYSTAL, LLC, San Clemente, CA (US)

(72) Inventors: Nassim Haramein, Carlsbad, CA (US); Scott Brown, San Clemente, CA (US); Kevin Kendrick, San Clemente, CA (US)

(73) Assignee: Ark Crystal, LLC, Redondo Beach, CA (US)

( * ) Notice: Subject to any disclaimer, the term of this patent is extended or adjusted under 35 U.S.C. 154(b) by 0 days.

(21) Appl. No.: 15/723,052

(22) Filed: Oct. 2, 2017

(65) Prior Publication Data

US 2019/0037978 A1 Feb. 7, 2019

Related U.S. Application Data

(60) Provisional application No. 62/539,906, filed on Aug. 1, 2017.

(51) Int. Cl.

| | |
|---|---|
| ***A44C 17/02*** | (2006.01) |
| ***A44C 13/00*** | (2006.01) |
| ***A44B 17/00*** | (2006.01) |

(52) U.S. Cl.

CPC ..... *A44C 13/00* (2013.01); *A44B 17/00* (2013.01); *A44C 17/02* (2013.01); *A44C 17/0208* (2013.01); *A44D 2201/06* (2013.01); *A44D 2203/00* (2013.01)

(58) Field of Classification Search

CPC ..... A44C 17/02; A44C 17/0208; A44C 13/00; A44C 25/00; A44C 9/00; G09B 23/26; G09B 23/18; A44D 2203/00

USPC ..... 63/26, 29.1, 29.2

See application file for complete search history.

(56) References Cited

U.S. PATENT DOCUMENTS

| | | | | |
|---|---|---|---|---|
| 1,332,206 A * | 3/1920 | Dinhofer | A44C 17/02 63/28 |
| 1,434,388 A | 11/1922 | Hughes | |
| 2,032,955 A | 3/1936 | Roussy | |
| 2,057,942 A | 10/1936 | Fay | |
| 2,716,292 A | 8/1955 | Benjamin | |
| 2,868,568 A | 1/1959 | Frye | |
| 3,115,758 A * | 12/1963 | Eberle | A44C 9/00 24/338 |
| 3,148,539 A | 9/1964 | Cook | |

(Continued)

FOREIGN PATENT DOCUMENTS

| | | |
|---|---|---|
| EP | 2172123 | 4/2010 |
| GB | 2463977 A | 4/2010 |

(Continued)

OTHER PUBLICATIONS

International Search Report for PCT Application No. PCT/US2017/054788, dated Apr. 27, 2018.

(Continued)

*Primary Examiner* — Emily M Morgan

(74) *Attorney, Agent, or Firm* — Fish IP Law, LLP

(57) ABSTRACT

Modular frames configured to couple with one another without external fasteners are provided. Some contemplated frames include magnetic fasteners positioned within an edge covering portion, and are configured to removably couple with at least one of another frame and a frame holder.

14 Claims, 14 Drawing Sheets

(56) References Cited

U.S. PATENT DOCUMENTS

| | | | | |
|---|---|---|---|---|
| 3,998,004 | A * | 12/1976 | Ehrlich | A63H 33/046 446/92 |
| 4,055,019 | A | 10/1977 | Harvey | |
| 4,129,975 | A | 12/1978 | Gabriel | |
| 4,214,404 | A | 7/1980 | Fischer | |
| 4,238,905 | A * | 12/1980 | MacGraw, II | A63H 33/046 446/92 |
| 4,701,131 | A | 10/1987 | Hildebrandt et al. | |
| 4,763,489 | A | 8/1988 | Strong | |
| 4,792,319 | A | 12/1988 | Svagerko | |
| 5,090,217 | A * | 2/1992 | Beber | A44C 17/02 269/156 |
| 5,183,430 | A | 2/1993 | Swann | |
| 5,430,989 | A | 7/1995 | Jones | |
| 5,472,365 | A | 12/1995 | Engel | |
| 5,491,986 | A * | 2/1996 | White | A44C 11/005 24/115 G |
| 5,575,701 | A | 11/1996 | Hantman | |
| 5,707,268 | A | 1/1998 | Outman | |
| 5,897,417 | A | 4/1999 | Grey | |
| 6,059,631 | A | 5/2000 | Maddock | |
| 6,164,815 | A | 12/2000 | Degonda | |
| 6,176,757 | B1 | 1/2001 | Lin | |
| 6,325,694 | B1 | 12/2001 | Clever et al. | |
| 6,382,982 | B1 | 5/2002 | Wilcox et al. | |
| 6,450,853 | B1 | 9/2002 | Larws | |
| 6,558,065 | B2 | 5/2003 | Huang | |
| 7,154,363 | B2 * | 12/2006 | Hunts | H01F 7/0242 335/306 |
| 7,156,392 | B2 | 1/2007 | Plein | |
| 7,316,598 | B1 | 1/2008 | Lock | |
| 7,780,499 | B1 | 8/2010 | Truckai | |
| 9,003,831 | B1 | 4/2015 | Azar et al. | |
| 9,199,182 | B2 | 12/2015 | Hunts | |
| 9,314,707 | B2 * | 4/2016 | Ornstein | A63H 33/046 |
| 9,466,228 | B2 * | 10/2016 | Haramein | G09B 23/181 |
| 9,636,600 | B2 * | 5/2017 | Rudisill | A63H 33/046 |
| 9,643,100 | B2 * | 5/2017 | Fein | A63H 33/046 |
| 10,080,977 | B2 * | 9/2018 | Rosen | A63H 33/101 |
| 10,255,826 | B2 * | 4/2019 | Haramein | G09B 23/181 |
| 10,861,350 | B2 * | 12/2020 | Haramein | G09B 23/26 |
| 2002/0000097 | A1 * | 1/2002 | Butler | A44C 17/02 63/26 |
| 2002/0083738 | A1 * | 7/2002 | Katz | A44C 11/007 63/31 |
| 2003/0007829 | A1 | 1/2003 | Huang | |
| 2005/0026535 | A1 | 2/2005 | Balanchi | |
| 2005/0115274 | A1 * | 6/2005 | Douglas | A44C 17/02 63/27 |
| 2007/0190892 | A1 | 8/2007 | Manvelian | |
| 2010/0083702 | A1 | 4/2010 | Joseph | |
| 2011/0083348 | A1 * | 4/2011 | Brouwer | G09F 3/20 224/257 |
| 2011/0107706 | A1 | 5/2011 | Fleishman | |
| 2013/0267145 | A1 * | 10/2013 | Rosen | A63H 33/046 446/92 |
| 2013/0269389 | A1 * | 10/2013 | Spadaro | A44C 25/001 63/23 |
| 2013/0327088 | A1 * | 12/2013 | Smith | A44C 17/0216 63/15 |
| 2014/0072942 | A1 * | 3/2014 | Haramein | G09B 23/26 434/281 |
| 2015/0121959 | A1 * | 5/2015 | Huynh | A44C 17/04 63/28 |
| 2016/0184727 | A1 * | 6/2016 | Ornstein | A63H 33/046 446/92 |

FOREIGN PATENT DOCUMENTS

| | | | |
|---|---|---|---|
| GB | 2466724 | A | 7/2010 |
| WO | WO02055168 | A1 | 7/2002 |
| WO | WO2007091885 | A1 | 8/2007 |
| WO | WO2008061359 | A1 | 5/2008 |
| WO | WO2010138995 | A1 | 12/2010 |

OTHER PUBLICATIONS

EP Search Report dated Mar. 30, 2021 for EP Application No. 17919858.5 filed on Jan. 30, 2020 entitled Modular Frames For Geometric Solids in the name of Ark Crystal (7 pages).

* cited by examiner

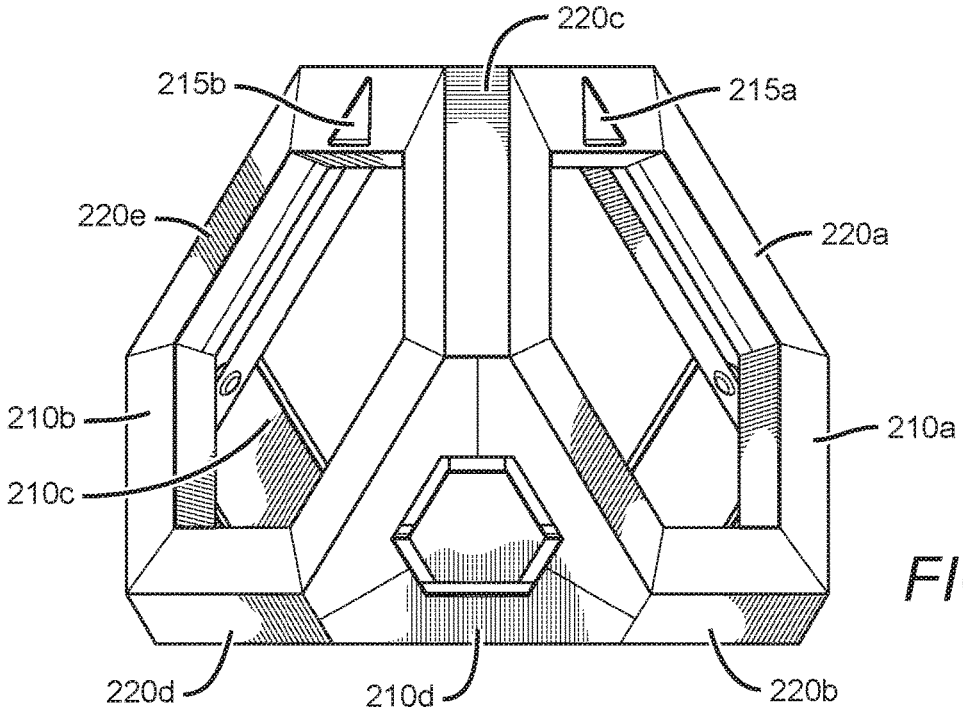
FIG. 2B
FIG. 2C
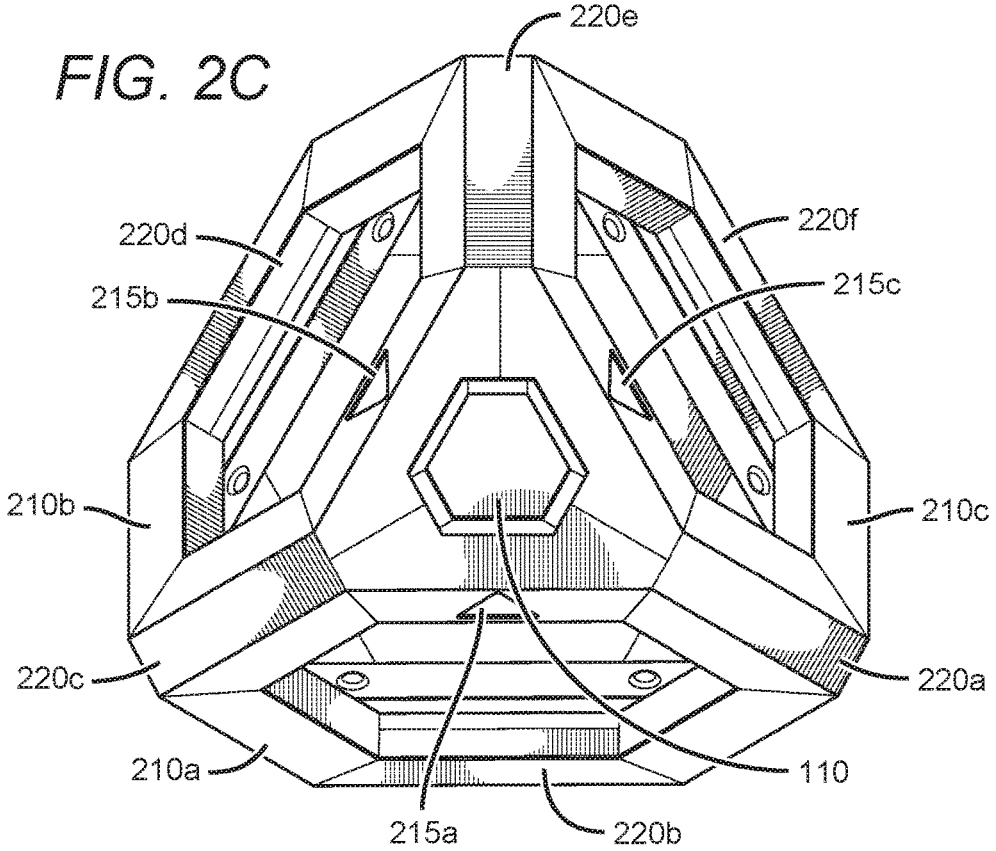

FIG. 3C
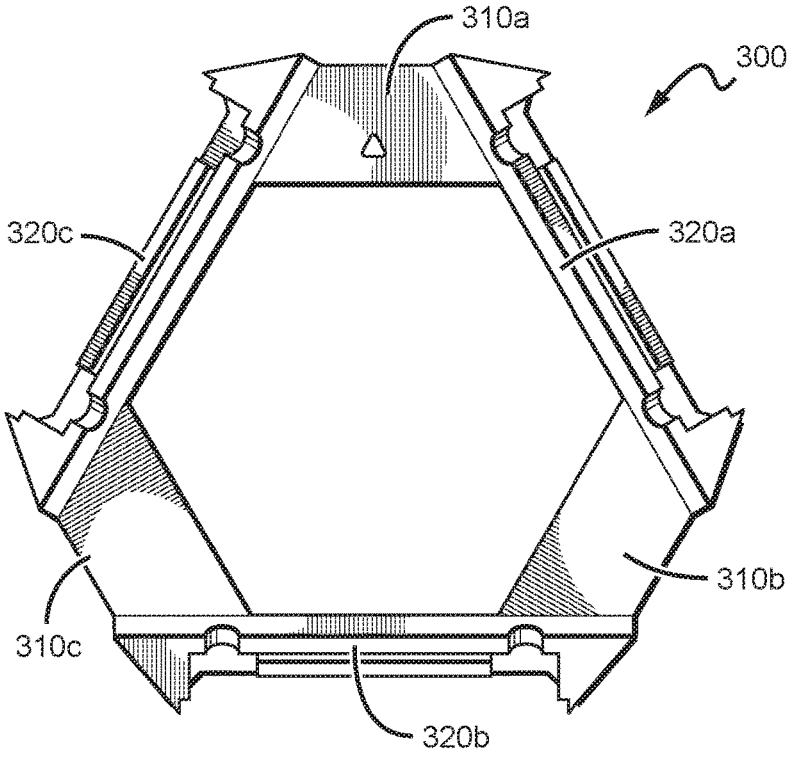
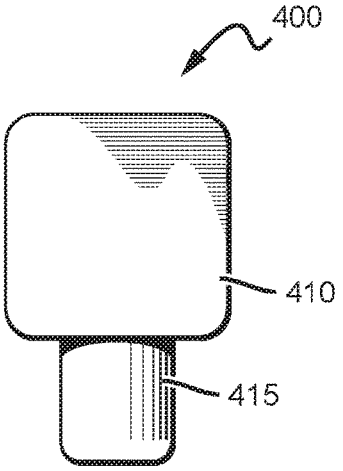
FIG. 4A
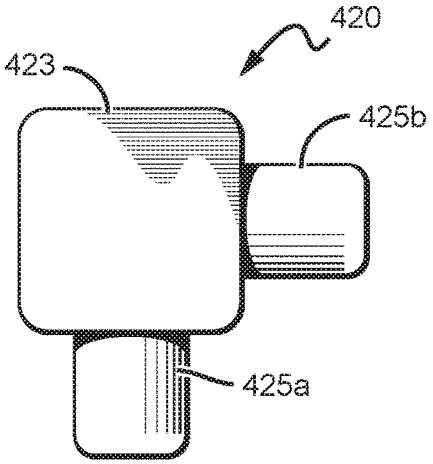
FIG. 4B
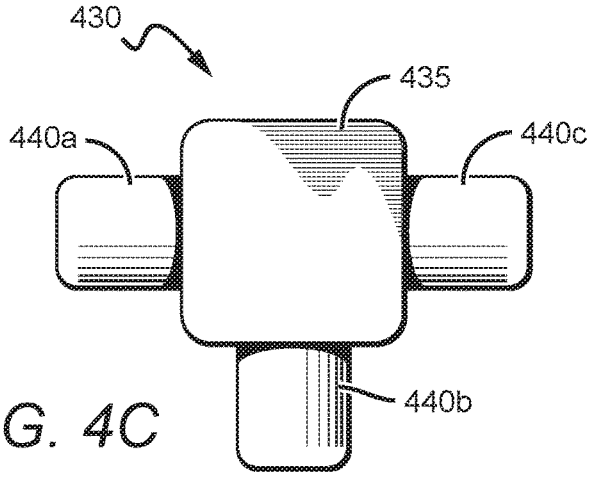
FIG. 4C

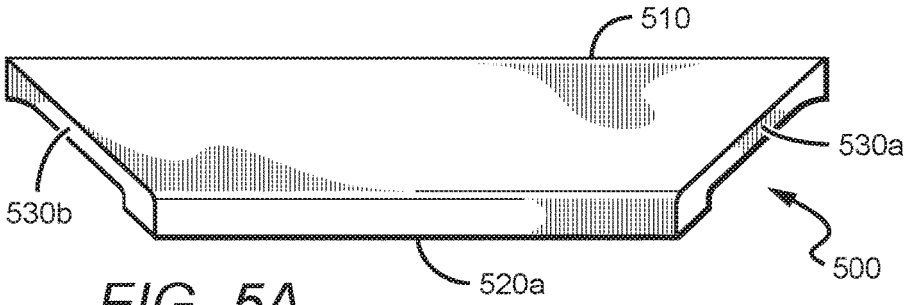
FIG. 5A
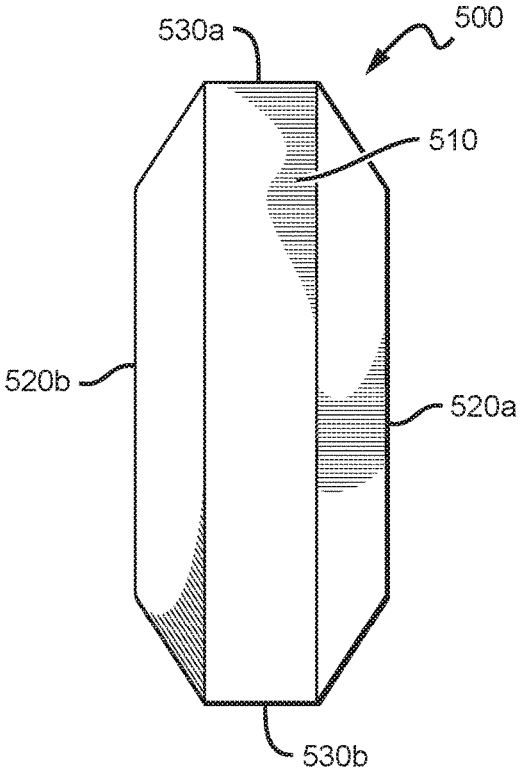
FIG. 5B
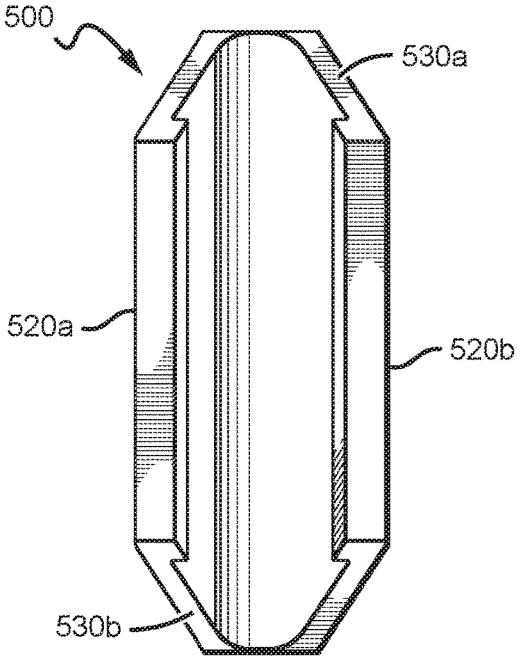
FIG. 5C
FIG. 5D
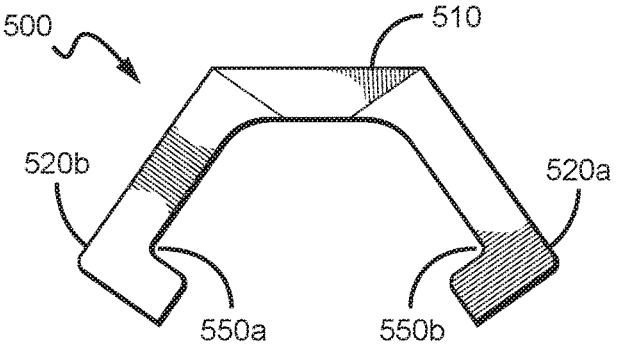

FIG. 6I
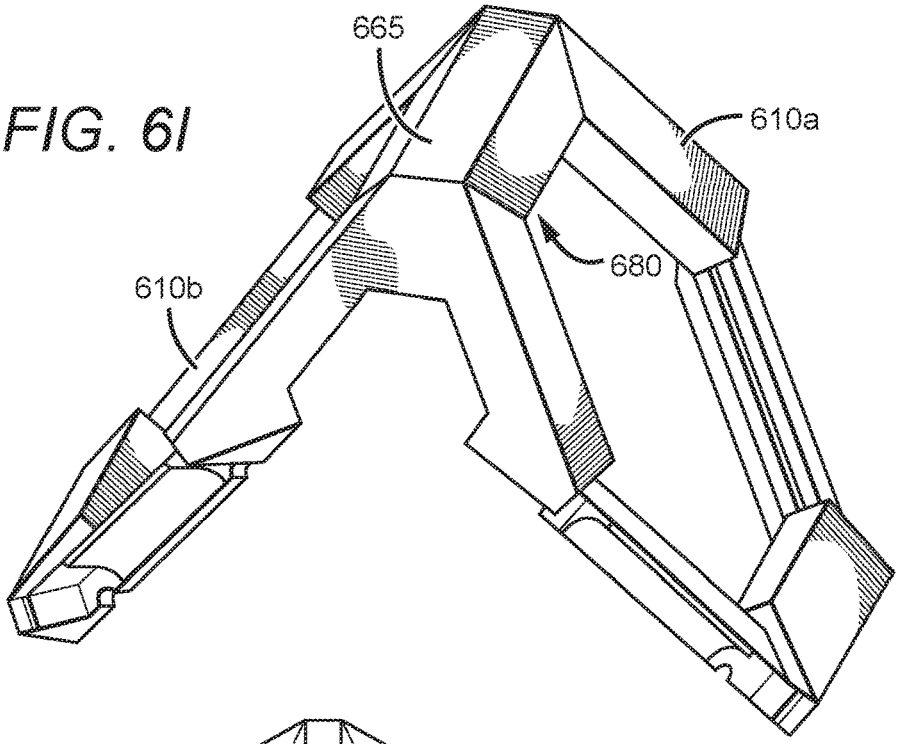
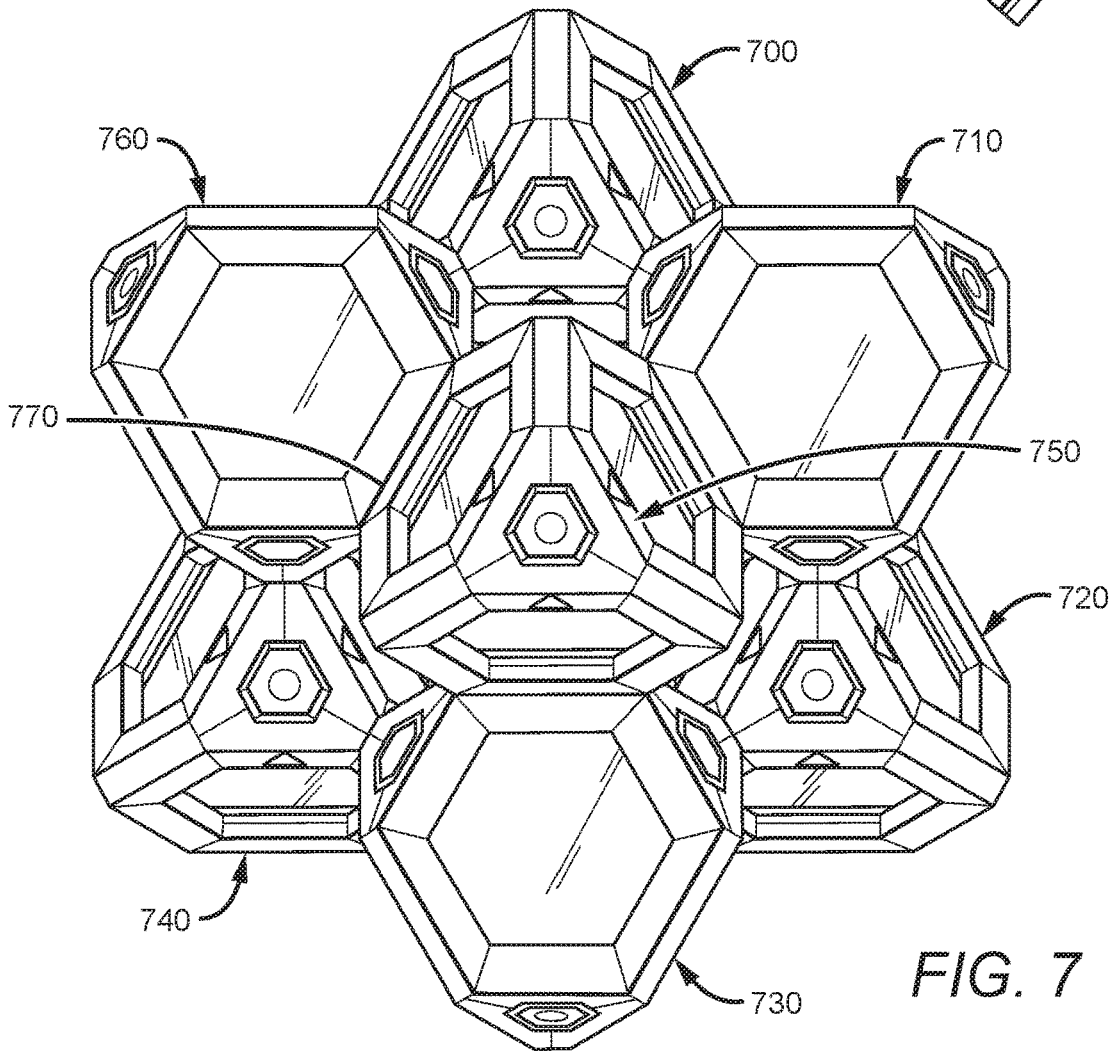
FIG. 7

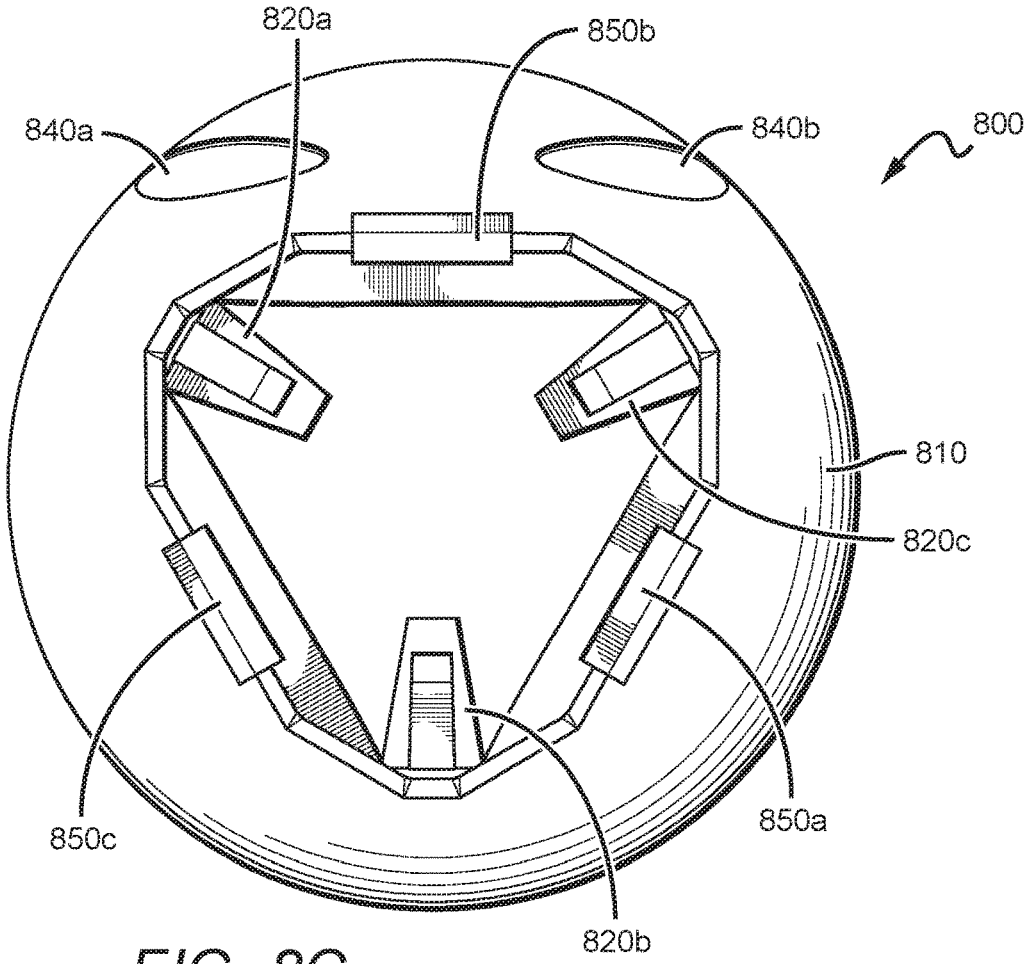
FIG. 8C
FIG. 8D
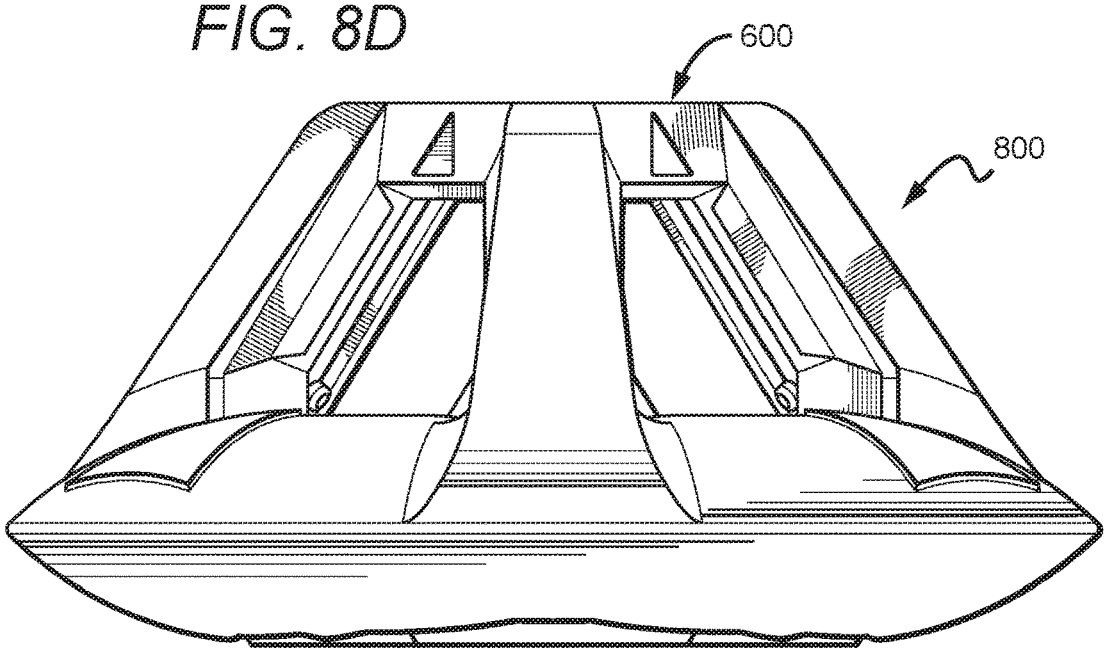

FIG. 8E
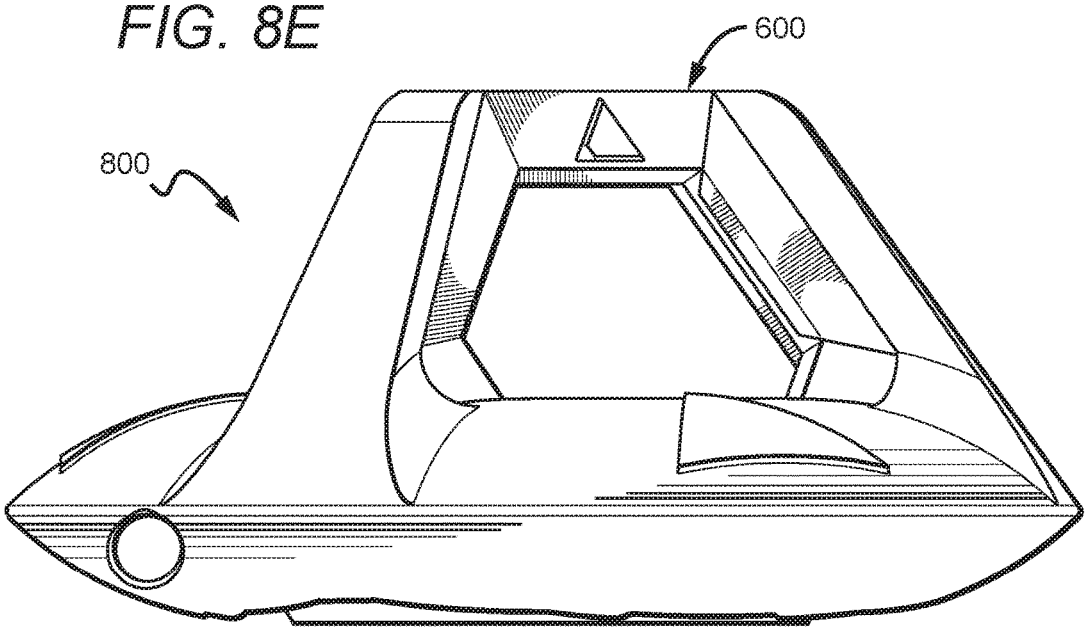
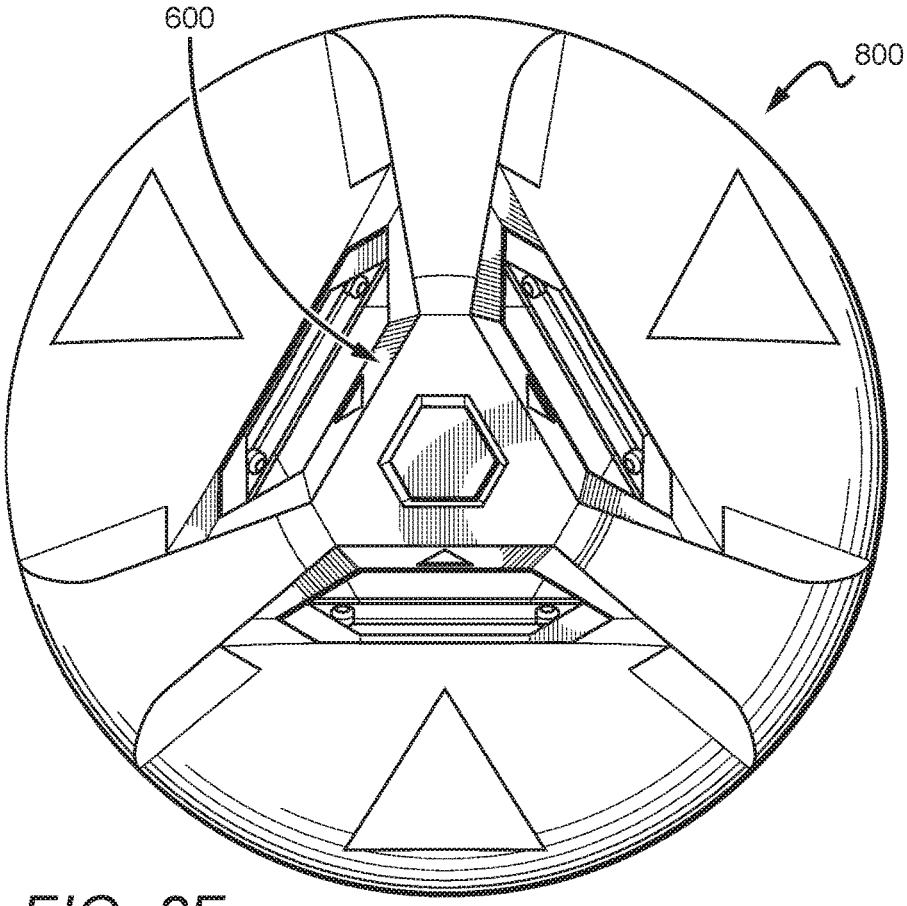
FIG. 8F

MODULAR FRAMES FOR GEOMETRIC SOLIDS

This application claims priority to U.S. provisional application No. 62/539,906 for Modular Frames For Geometric Solids, filed on Aug. 1, 2017. This and all other extrinsic materials discussed herein are incorporated by reference in their entirety as if each were specifically indicated to be incorporated by reference. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is frames, especially frames for geometric solids.

BACKGROUND OF THE INVENTION

Ornamental items (e.g., rings, necklaces, bracelets, watches, armbands, anklets, etc.) and other wearable items often comprise a frame that holds geometric solids such as gems, crystals, or pendants in place. In many known scenarios the geometric solid is permanently coupled to a frame; a ring setting or broach for example. In other known examples, some modularity is provided, but various moving pieces are required, which could lead to loss, as well as damage over extended use.

French patent application publication number FR 2618311 to Fullin teaches a modular pendant for earrings having two elements with triangular profiles that couple to one another in a few different configurations via a housing and an apparent snap-fit connection between the housing and the two elements. Unfortunately, Fullin's earrings do not appear to be configured to act as a frame for any geometric solid, and appear to have couplers (projections) that only allow for a very limited degree of modularity.

U.S. Pat. No. 9,199,182 to Hunts teaches a building component including a housing with a recess, and connector arms partially disposed within the recess and configured to couple with an axle positioned within a recess of another building component. Similarly to Fullin, Hunts building components appear to have couplers that only allow for a limited degree of modularity. Additionally, Hunt's snap-fit connection could lead to damage or loss of the connection arms or axel over time. Additionally, the coupling between building components may be weak and unsuitable for use as a frame.

Thus, there is still a need for improved modular frames for geometric solids.

SUMMARY OF THE INVENTION

The present invention is directed to devices and methods for modular frames for geometric solids. As used herein, a "frame" includes an object that at least partially encloses and surrounds a geometric solid. In some preferred embodiments, the frame surrounds at least 10%, at least 15%, at least 25%, at least 50%, at least 60% or even more of a surface area of a geometric solid such as a crystal gem. In some preferred embodiments, the frame surrounds less than 10%, less than 15%, less than 25%, less than 30%, less than 35% or even less of a surface area of a geometric solid. In some preferred embodiments, the frame is positioned over each edge of the geometric solid. In some preferred embodiments, the frame is positioned over or around each vertex of the geometric solid. Some contemplated frames are configured to be used as individual frames, but could also advantageously be coupled with one or more other frames to form a larger jewelry item having multiple frames. Additionally or alternatively, a frame kit could be provided that is configured to form frames suitable for geometric solids of different sizes and shapes. For example, the frame kit could be used to form a frame for a modified tetrahedron crystal, and could be taken apart and be used to form a frame for a multi-tetrahedron matrix. Preferably, the modular frames could be coupled to one another without the need for any external connectors (e.g., clips, connector arms) that could easily break or be lost. Viewed from a different perspective, all that is needed to form a larger jewelry item (with multiple frames holding multiple geometric solids) is the individual frames themselves, as they would be worn as individual frames.

In some aspects of the inventive subject matter, a modular frame for a geometric solid comprises (a) a first panel having a first window and a first side or arm that includes (1) a first mating edge and (2) a second edge different from the first mating edge and including a first catch, and (b) a second panel having a second window and a second side or arm that includes (1) a second mating edge and (2) a second edge different from the second mating edge and including a second catch. The first and second panels could couple to one another to form a recess or seat sized and dimensioned to receive a magnet. A first clip could be positioned over the magnet, and around at least a portion of the first arm and at least a portion of the second arm. The clip could include first and second clasps that are configured to mate with first and second catches of the first and second panels to form a first edge covering portion that includes a length of each of the first and second arms partially enclosed by the first clip. The first edge covering portion could advantageously be sized and dimensioned to be positioned over a chamfered edge of a geometric solid.

It is contemplated that a cylindrical or other magnet could be positioned in the first edge covering portion (e.g., between the clip and the first and second arms), which allows the frame to removably attach or otherwise couple with one or more different frames or objects (e.g., water bottle, pendant, decorative element of a different type made to fit the frame and removably attach to it).

It should be appreciated that frame panels and frames could have any suitable shape(s) to at least partially enclose or orient a geometric solid or a matrix of geometric solids. For example, contemplated frame(s) could be sized and dimensioned to hold a geometric solid that is of cuboctahedron, tetrahedron, icosahedron, cubic, rectangular cubic, dodecahedron, spheric or ovoid shape. Contemplated frame(s) could also be sized and dimensioned to hold a multi-tetrahedron or other matrix (see e.g., http://www.abzu2.com/2014/01/29/the-flower-of-life-and-the-6-1-tetrahedron-grid-the-other-and-father-of-the-geometry-of-the-fabric-space/). The frame(s) could be matched in orientation to the molecular orientation of the crystal lattice itself. A serial number could be included on the frame, for example, on the bottom frame panel and perpendicular to the x-axis of the geometric tetrahedron on the x-end of that axis. The crystal itself could also include a serial number, for example, one also positioned perpendicular to the x-axis on the x+ end of said axis.

Contemplated frame panels could comprise any suitable number of sides (e.g., 2, 3, 4, 5, 6, 7, 8, 9, 10 or more), and the sides could have the same or different lengths, widths, shapes and curvatures. For example, a side (arm) that is configured to form a portion of an edge covering portion could comprise notches that are relatively small, and catches that extend along a substantial length of the side or arm (e.g., at least 25%, at least 50%, at least 65% of a length of the side), while a side that is configured to form a portion of a vertex saddle (a portion of the frame that is positioned over or around a vertex saddle, and optionally includes an opening sized and dimensioned to frame the vertex saddle) could have an irregular octagonal or other shape.

Where the geometric solid has four primary faces of substantially the same size (e.g., a truncated and chamfered tetrahedron), a modular frame could be made from four identical panels. Similarly, where the geometric solid has five, six, seven, eight or nine primary faces of substantially the same size, the modular frame could be made from five, six, seven, eight or nine identical panels, respectively. However, it should be appreciated that panels used to frame geometric solids having primary faces of substantially the same size and shape (or different sizes and shapes) could be different from one another. For example, a first frame panel having a side arm including a seat sized and dimensioned to receive a magnet fastener could be configured to mate with a second frame panel having a side arm that is thinner than the side arm of the first frame panel. One or both of the side arms could include a catch sized and dimensioned to block a clasp of a clip in place, for example below the clasp.

Additionally or alternatively, in some instances, for example where the geometric solid has a face that is generally triangular in shape, the frame panels could similarly be triangular in shape. Similarly, where the geometric solid has a face that is generally ovular, rectangular, pentagonal, hexagonal or heptagonal in shape, the frame panel could have an ovular, rectangular, pentagonal, hexagonal or heptagonal shape, respectively. Additionally or alternatively, in some instances, for example where the geometric solid has a face that is generally triangular in shape with truncated vertices, the frame panels could include six arms—three of which substantially align with the edges of the geometric solid, and three of which substantially align with the truncated vertices.

Similarly, it is contemplated that frame panels could include windows of any suitable size and shape that allow users to see portions of the framed geometric solid. The openings could have the same general shape as the frame panel itself (e.g., regular or irregular oval, regular or irregular rectangle, regular or irregular pentagon, regular or irregular hexagon, regular or irregular heptagon, regular or irregular octagon), or any other suitable shape (e.g., shape of an alphanumeric character, logo, image, different regular or irregular shape).

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIGS. 2A-2C illustrate a detailed side face view (2A), side edge view (2B), and top view (2C) of an individual frame for the geometric solid of FIG. 1.

FIGS. 3A-3C illustrate a panel of an individual frame.

FIGS. 4A-4C illustrate a bumper.

FIGS. 5A-5D illustrate a clip.

FIGS. 6A-6I illustrate different components of an individual frame.

FIG. 7 illustrates a jewelry item comprising multiple individual frames coupled with one another.

FIGS. 8A-8H illustrate a frame holder of the inventive subject matter, with FIGS. 8D-8H showing the frame holder coupled with an individual frame.

DETAILED DESCRIPTION

Figure 1:
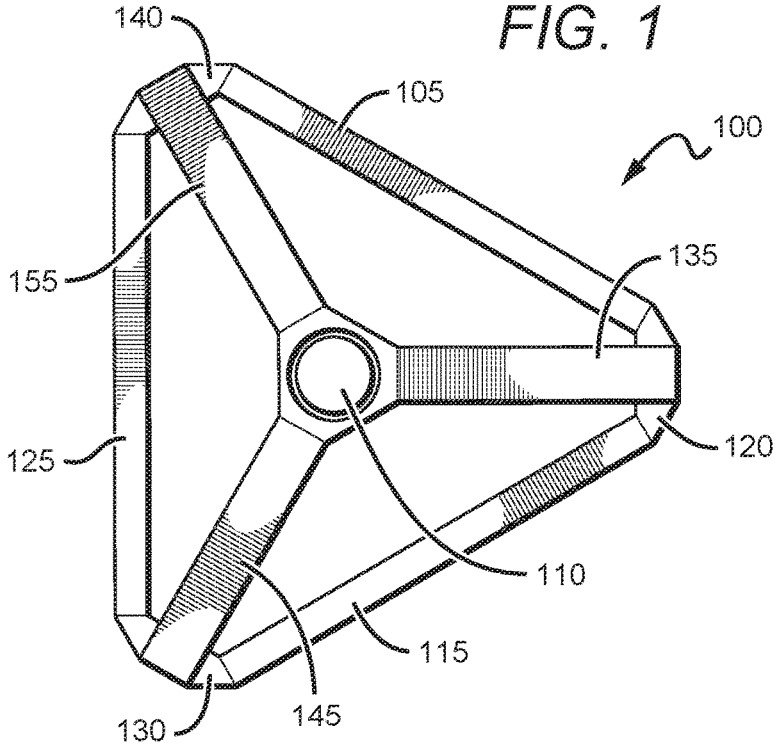
FIG. 1 illustrates a top view of a geometric solid of the inventive subject matter.

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The inventors have discovered that single frames could be made in a manner that allows a user to removably couple it with one or more other identical, similar or substantially different frames without the need for additional fasteners. Contemplated frames could be configured to hold a geometric solid, and optionally provide windows through which portions of the geometric solid is visible when the frames are worn by a user (e.g., as a necklace), or otherwise displayed.

Modular frames of the inventive subject matter provide for at least one of securing and orienting one or more geometric solids (for example, a crystal or a crystalline solid), preferably possessing at least one vertex and one edge. Such an apparatus, system, or method can serve as an educational tool utilized in the demonstration or investigation of effects realized by the placement or orientation of such a geometric solid relative to its environment. Similarly, embodiments of the inventive concept can serve as educational tools utilized in the investigation of effects realized by the placement or orientation of a plurality of geometric solids relative to their environment or to each other. Indicators, such as etching, an image, an opening, alphanumeric characters, serial number, or a logo could be provided along different portions of the frame (or the geometric solid itself) that informs a user of the orientation of such a preferred axis or pole relative other orientations. Further, especially in embodiments where the geometric solid includes a crystal, such a crystal can include additional indicia, including a serial number, a name, a manufacturer, a logo, an orientation relative to a parent crystal, a location relative to a parent crystal or block from which the crystal was cut, or other information. A serial number could be included on the frame, for example, on a frame panel or a clip, and another serial number (same or different) could be included on the crystal. In some embodiments, the frame could be matched in orientation to the molecular orientation of the crystal lattice itself, and the serial numbers could provide an indication of such match. For example, a serial number could be included on a bottom frame panel, and positioned perpendicularly to the x-axis of the crystal on the x− end of that axis. The crystal itself could also include a serial number, and be positioned perpendicular to the x-axis on the x+ end of said axis.

The frame can include at least one vertex saddle configured to receive or frame a vertex of a geometric solid. Preferably, the vertex saddle is made via a coupling of two or more frame panels. The frame can further comprise at least one edge strut (or an edge covering portion), which could also be made via a coupling of two or more frame panels. Such an edge strut can be configured to cover or conform to at least a portion of an edge of a geometric structure. In some embodiments, the frame can include multiple frame panels, saddles and struts configured to hold a truncated and chamfered tetrahedron solid or other geometric solid of any suitable shape (e.g., trihedral, icosahedron, cube, rectangular cube, sphere, ovoid, etc.). Where the geometric solid includes curvatures, it is contemplated that some or all of the frame panels could be curved rather than generally flat.

FIG. 1 illustrates an exemplary geometric solid of the inventive subject matter. Crystal 100 could be cut according to the methods described in U.S. Pat. No. 9,435,054.

Crystal 100 is a chamfered and truncated tetrahedron solid having six chamfered edges 105, 115, 125, 135, 145, 155, and four truncated vertices 110, 120, 130, and 140. However, it should be appreciated that contemplated geometric solids could comprise any suitable size, shape and material, and frame panels of the inventive subject matter could sized and dimensioned to form modular frames configured for securing, holding and orienting any suitable geometric solid.

Figure 2A:
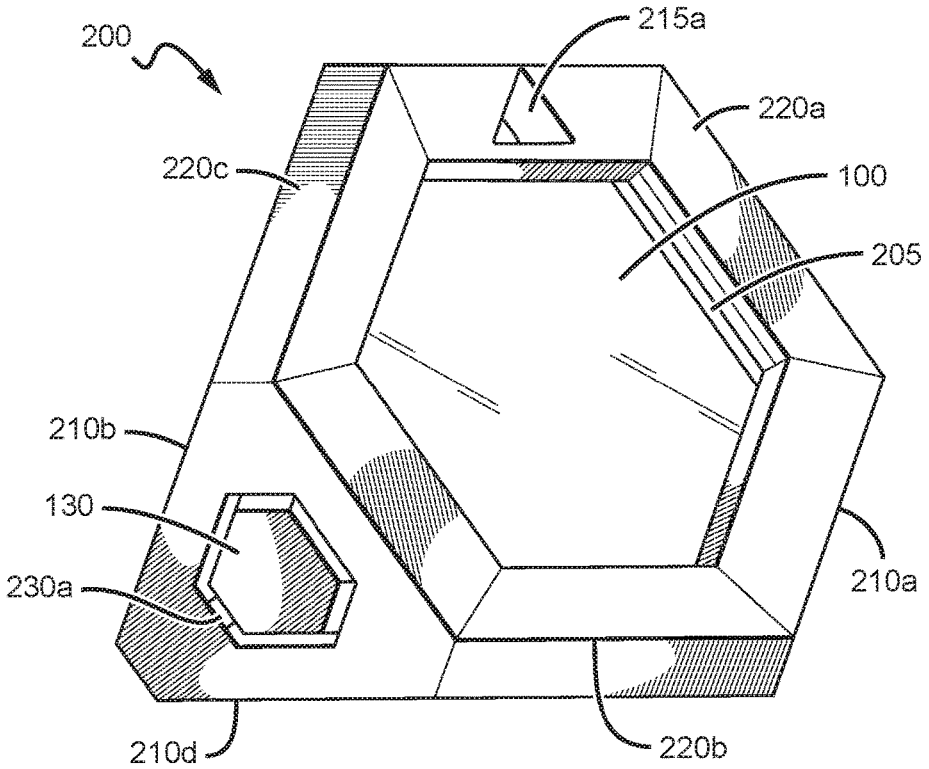

FIGS. 2A-2C show a modular frame 200 of the inventive subject matter partially enclosing crystal 100 and securing it in place. Frame 200 includes first frame panel 210*a*, second frame panel 210*b*, third frame panel 210*c*, and fourth frame panel 210*d*. First frame panel 210*a* is coupled to third frame panel 210*c* via first clip 220*a*, first frame panel 210*a* is coupled with fourth frame panel 210*d* via second clip 220*b*, first frame panel 210*a* is coupled to second frame panel 210*b* via third clip 220*c*, second frame panel 210*b* is coupled with fourth frame panel 210*d* via fourth clip 220*d*, third frame panel 210*c* is coupled with second frame panel 210*b* via fifth clip 220*e*, and third frame component 210*c* is coupled to fourth frame component 210*d* via sixth clip 220*f*. In some other embodiments, it should be appreciated that contemplated frames could include any suitable number of frame panels (e.g., at least 5, at least 6, at least 7, at least 8, between 5-10, between 4-8) and any suitable number of clips (e.g., at least 5, at least 6, at least 7, at least 8, between 5-10, between 4-8).

Each of the first, second and third frame components (210*a*, 210*b*, 210*c*) include indicia such as an opening, etching or image (215*a*, 215*b*, 215*c*) which could identify the preferred orientation of crystal 100 relative to the Z+ or C axis. The Z axis is the optical axis, and is generally known as the axis of growth. The Z− end of the axis is the base of crystal growth, and the Z+ end of the Z axis is the direction of the crystal growth. The crystals could also be oriented relative to the X-axis. For example, the crystal could be serialized on the lower edge chamfer perpendicular to the x-axis on the x+ end of the x-axis. The s-axis is the electric axis and the x+ end exhibits a positive voltage when the crystal is compressed along this axis. Chamfered edge covered by clip 220*b* is one area where the serial number could be etched into the crystal. Bumpers (e.g., foam, gel, silicone) are provided via frame 200, which advantageously create a gap (e.g., 205) between an inner surface of frame 200 and a face, edge or vertex of crystal 100. Contemplated gaps could be of any suitable length (e.g., between 1-10 mm, between 1-5 mm), and could be uniform throughout the length of the crystal and frame. For example, as illustrated in FIG. 2A, bumper 230*a* prevents portions of crystal 100 near vertex 130 from directly contacting the frame panels. Contemplated bumpers could advantageously prevent crystal 100 from damage that would otherwise potentially be caused by frame 200 or frame panels 210*a*, 210*b*, 210*c*, or 210*d*. Additionally or alternatively, the bumpers could include protrusions or extensions having some give or springiness such that crystals of different sizes could securely fit within frame 200. Additionally or alternatively, the bumpers could be interchanged with bumpers that protrude through frames to different extents to accommodate crystals of different sizes. Where a crystal is relatively small, bumpers that protrude through the frames to a greater extent could be provided to prevent movement of the crystal within the frame. Where a crystal is relatively large, bumpers that protrude through the frames to a lesser extent could be provided. In some embodiments, bumpers may have a range as low as 0.5 mm. Viewed from a different perspective, the length of the bumper extension, uncompressed, could be as low as 1.0 mm, as low as 0.7 mm, as low as 0.5 mm. The bumper extension could then be compressed when the crystal is installed in the frame.

Figure 3A:
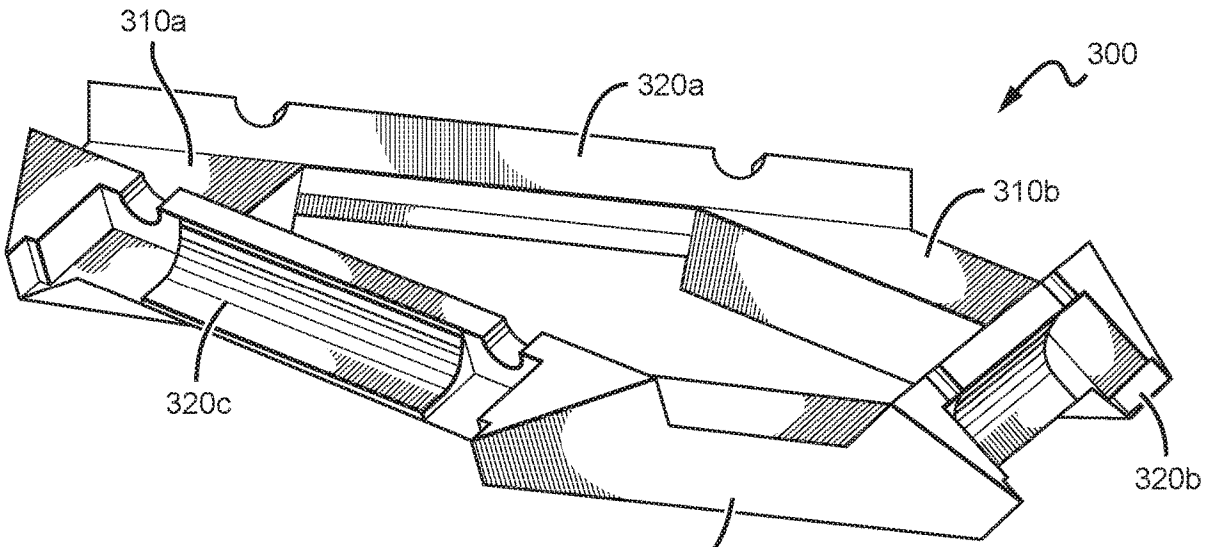
Figure 3B:
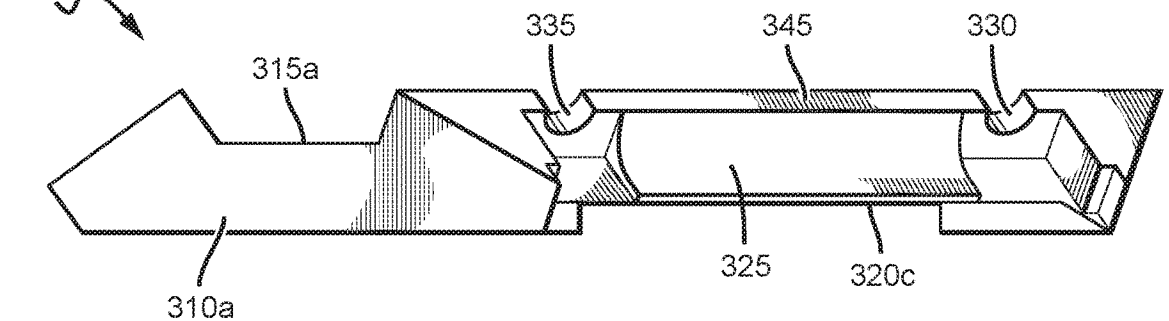

FIGS. 3A-3C illustrate a single frame panel 300, which is suitable as a building block to frame a tetrahedron solid, especially a truncated and chamfered tetrahedron solid. Frame panel 300 includes sides, which include three vertex saddle forming sides 310*a*, 310*b* and 310*c*, and three edge strut forming sides 320*a*, 320*b* and 320*c*.

As best seen in FIG. 3B, one or more of the edge strut forming sides (e.g., 320*c*) could include a seat forming portion 325, and a mating edge 345 including first notch 330 and second notch 335. Edge strut forming side 320*c* could further include first and second recesses along a wall perpendicular (or substantially perpendicular—forming an angle of between 75-105 degrees) to mating edge 345, each of the recesses being sized and dimensioned to receive a portion of a bumper (see FIGS. 4A-4C) and secure it in place.

Frame panels of the inventive subject matter could be made of any suitable material or materials, including for example, plastic, silicone, rubber, wood, metal, gold, silver, or a composite material. Additional information relating to the coupling of the frame panels is provided below in connection with FIGS. 6A-6I).

FIG. 4A illustrates a bumper 400, which is configured to provide a gap between portions of a geometric solid and a frame. Bumper 400 has a base 410, which is sized and dimensioned to fit at least partially within a seat formed by one or more sides or one or more panels, and a protrusion 415 sized and dimensioned to extend through an opening formed by one or more panels. Bumper 400 and any of its components could be made from any suitable material or materials (e.g., plastic, metal, foam, gel, silicone). Protrusion 415, which acts to protect a crystal or other solid against a frame panel by creating a gap or acting as a spacer, is preferably made of a material that would not damage the crystal (e.g., a foam padding, soft plastic, gel, silicone). Protrusion 415 of bumper 410 is sized and dimensioned to extend through an opening formed by (a) notches (e.g., notch 330) of adjacent frame panels, or by (b) a side or arm of a single frame panel. Base 410 is preferably sized and dimensioned to fit between the frame panels and a clip that couples the frame panels to one another (see FIGS. 5A-5D).

FIG. 4B illustrates a bumper 420 having a base 423, and two protrusions 425*a* and 425*b*. Protrusion 425*a* is similar to protrusion 415, and protrusion 425*b* is sized and dimensioned to fit within a seat formed by one or more frame panels, and (a) act as a spacer between a surface of the frame panel (e.g., an inner side wall of the seat) and the base 423, (b) act as a spacer between a magnet positioned in the seat and the base 423, or (c) fit within a recess formed on a inner surface of the seat of one or more frame panels.

Bumper 430 is similar to bumpers 400 and 420, and comprises a base 435, protrusion 440*a*, protrusion 440*b*, and protrusion 440*c*. Protrusion 440*b* is similar to protrusion 415, and protrusion each of bumpers 440*a* and 440*c* is sized and dimensioned to fit within a seat formed by two or more frame panels, and (a) act as a spacer between a surface of the frame panel and the base 435, (b) act as a spacer between a magnet positioned in the seat and the base 435, or (c) fit within a recess formed on a inner surface of the seat.

FIGS. 5A-5D illustrate a clip 500 of the inventive subject matter, which is used to couple two or more frame panels to one another. Clip 500 includes a top 510, a front 530*a*, a back 530*b*, a first side 520*a* and a second side 520*b*, which extend from top 510. FIG. 5C illustrates a bottom view of clip, which shows top 510, first side 520*a* and second side 520*b* form a recess or channel sized and dimensioned to receive portions of first and second frame panels (e.g., a seat formed by the first and second frame panels), and secure them to one another, for example via a snap fit.

FIG. 5D illustrates a cross-sectional view of clip 500, which shows first side 520*a* and second side 520*b* are curved or bent to form first and second clasps having nooks 550*b* and 550*a*, which are sized and dimensioned to receive portions of the frame panels having a corresponding shape (e.g., a catch) via a snap fit. Preferably, clip 500 is made of a material that allows a distance between first and second sides 520*a* and 520*b* to be temporarily increased to fit over the catches, and automatically spring back to its original shape.

Clips of the inventive subject matter could be made of any suitable material or materials, including for example, plastic, silicone, rubber, wood, metal, gold, silver, or a composite material. The material of the clip could be the same as of different from the frame panels and the bumpers. In some preferred aspects, the clips are made of a material and thickness such that the magnetic force from a magnet seated between the clip and frame panels could pass through with sufficient intensity to couple with magnets or clips from a different frame. Additionally or alternatively, clips of the inventive subject matter could comprise any shape (e.g., cross-sectional shape, channel shape) that is, for example, suitable to be secured over lengths of first and second arms of first and second frame panels.

Figure 6A:
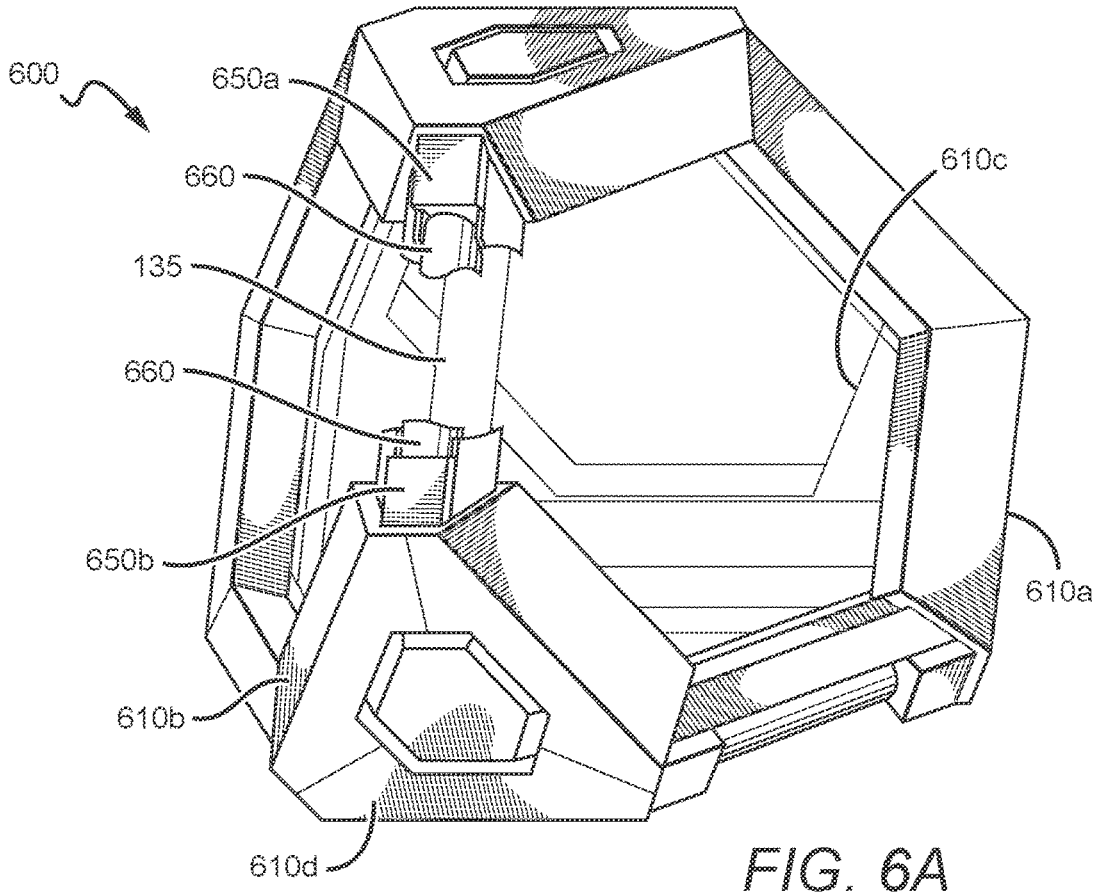

FIG. 6A illustrates another modular frame of the inventive subject matter 600, which includes a cut-away view, and a side with a clip removed, to show how panels are coupled together to form a seat in which bumpers and a magnet could be positioned.

Frame 600 comprises four frame panels (610*a*, 610*b*, 610*c* and 610*d*), and is sized and dimensioned to hold a crystal (e.g., crystal 100). Three frame panels (e.g., 610*a*, 610*b*, 610*d*) couple with one another to form each vertex saddle, which could include an opening having a shape that is the same as, or different from, the truncated vertex of the crystal. The opening could be oversized relative to the truncated vertex to accommodate gaps formed between frame 600 and crystal 100 by bumpers (e.g., bumpers 650*a* and 650*b*), for example where the frame's vertex saddle is flush or substantially flush with the truncated vertex of the crystal.

Furthermore, the vertex saddle could include an opening that is tapered such that a gap between the inner surface of the vertex saddle and an outer surface of the crystal is the same at each point that the vertex saddle is positioned over a portion of the crystal. This is best seen in FIG. 7 where at least three sides of the vertex saddle have outer surfaces that are angled to parallel the truncated crystal. In some embodiments, some or all frame faces (which includes portions of a frame panel and 3 clips), and some or all sides of the frame could be at least one of parallel to a face of the geometric solid and planar (not taking the window into consideration).

As illustrated, a portion of an edge strut has been cut away, and the clip removed, to show the arrangement of bumpers 650*a* and 650*b*, and magnet 660 positioned therebetween. The edge strut that has been cut away is sized and dimensioned to cover a chamfered edge 135 of crystal 100.

Figure 6B:
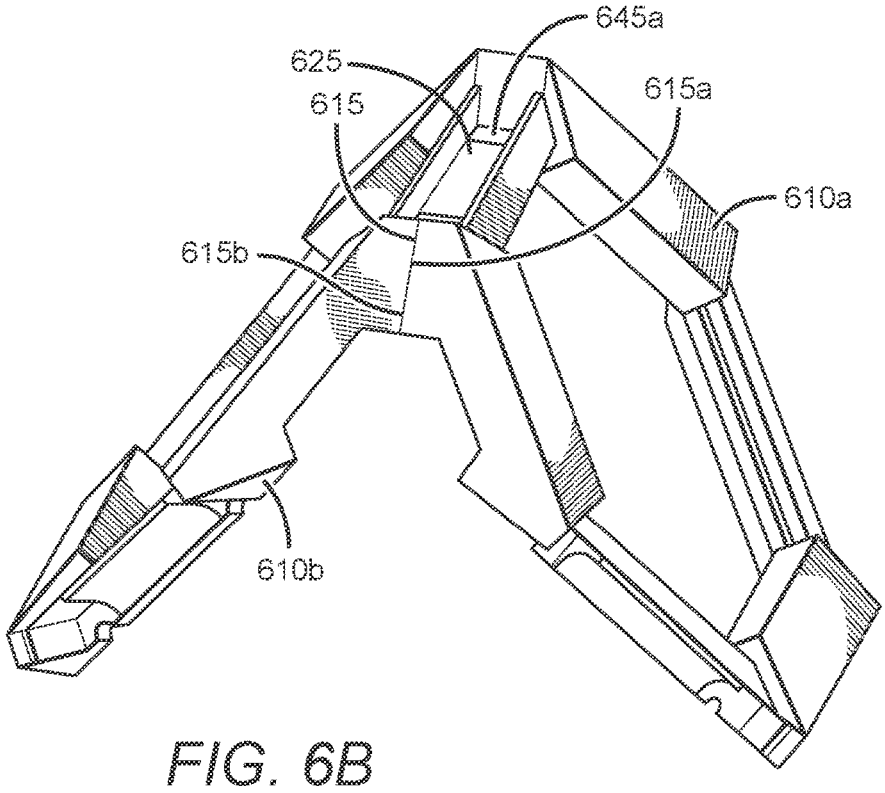
Figure 6C:
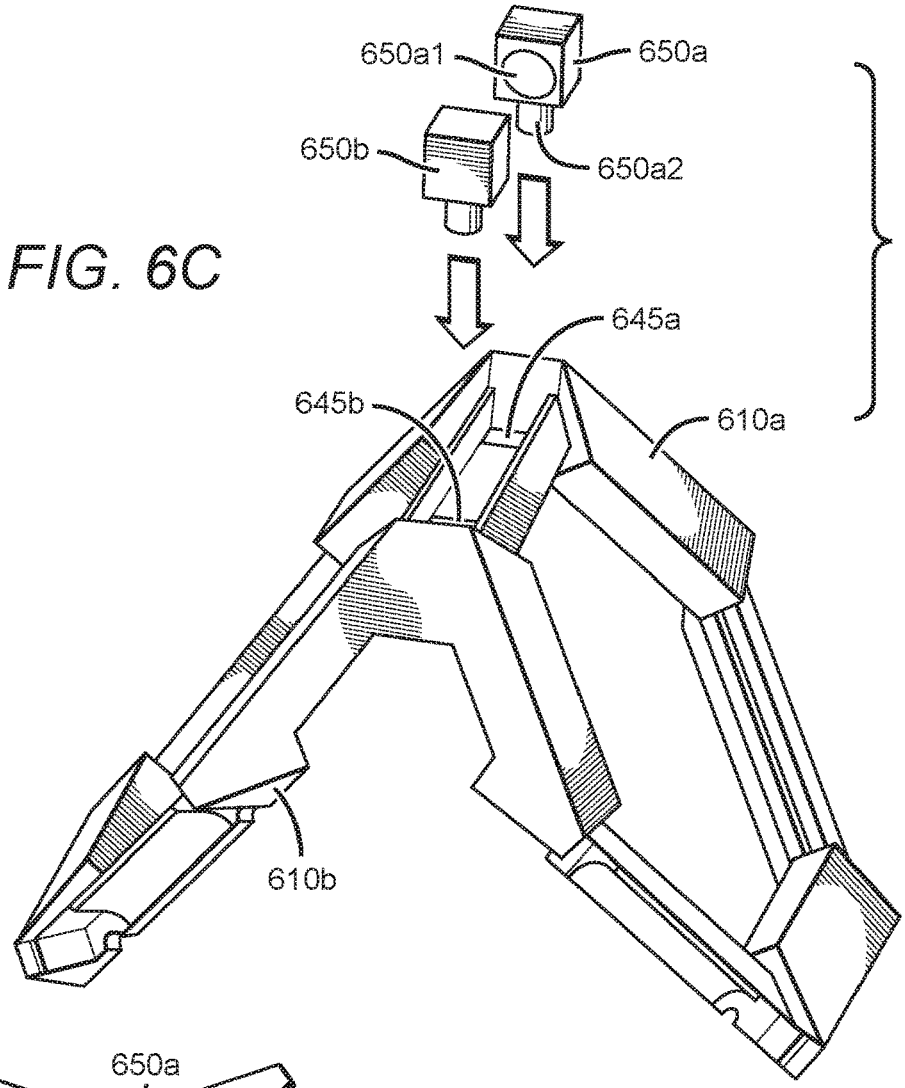
Figure 6D:
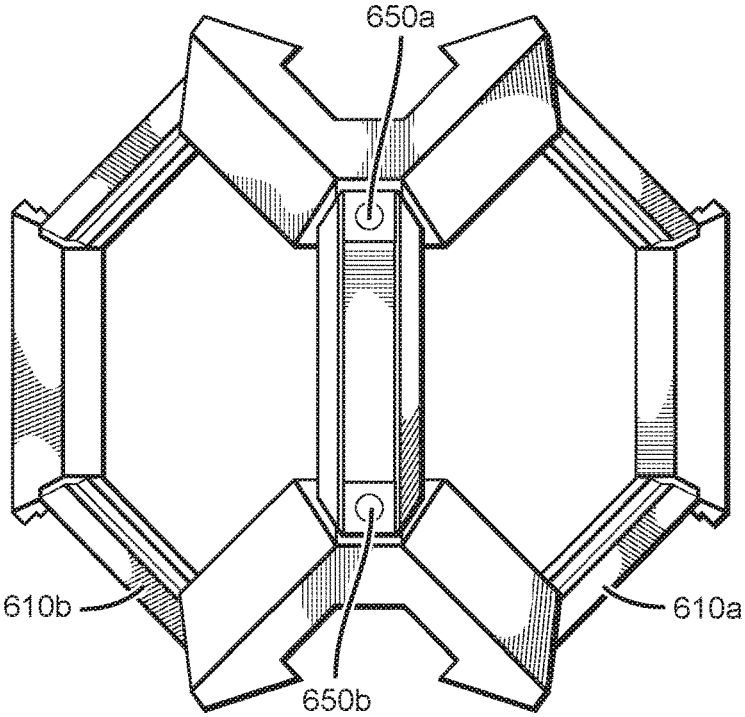
Figure 6E:
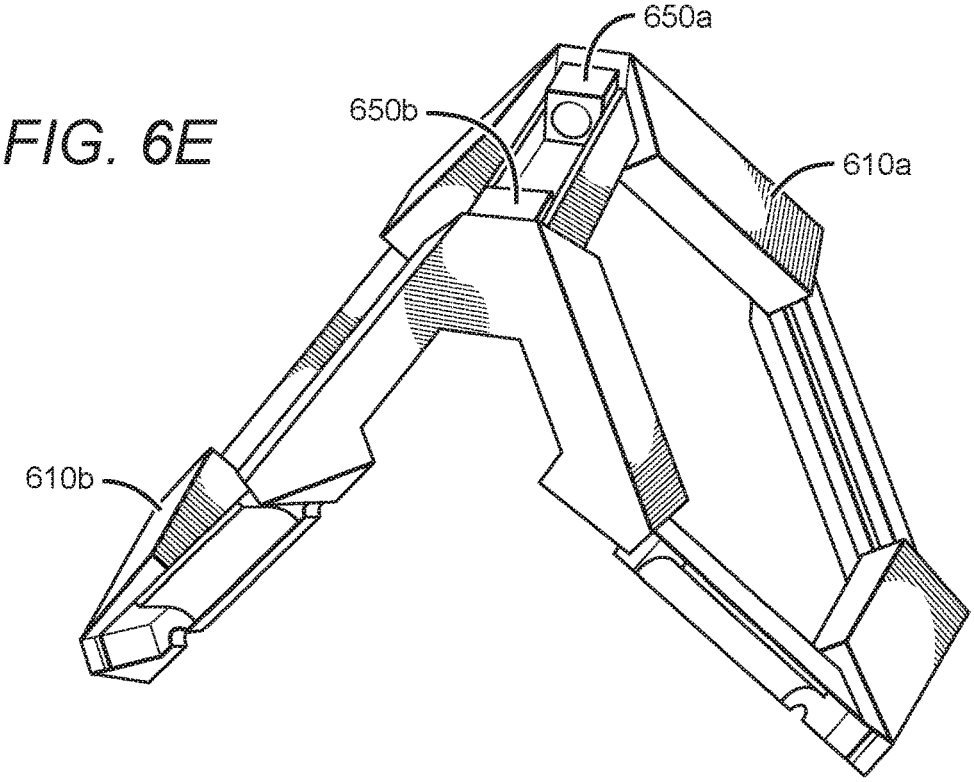

FIG. 6B illustrates two frame panels being placed relative to one another to form a portion of frame 600. Frame panel 610*a* includes a mating surface 615*a* along a first arm, which is sized and dimensioned to align with a mating surface 615*b* along a first side of frame panel 610*b* to form a connection point 615 of a vertex saddle. When mating surfaces 615*a* and 615*b* align with one another, a seat 625 is formed. Seat 625 could be sized and dimensioned to receive one or more magnets or other fasteners, and one or more bumper bases, where desired. As shown in FIGS. 6C-6E and described above with FIGS. 3A-3C, one or more openings 645*a* and 645*b* could be formed via notches on first and second frames 610*a* and 610*b*, which could be sized and dimensioned to receive protrusions (e.g., 650*a*1, 650*a*2) of a bumper (e.g., 650*a*, 650*b*). Additionally or alternatively, one of the frame panel arms could include an opening sized and dimensioned to receive the protrusions.

Figure 6F:
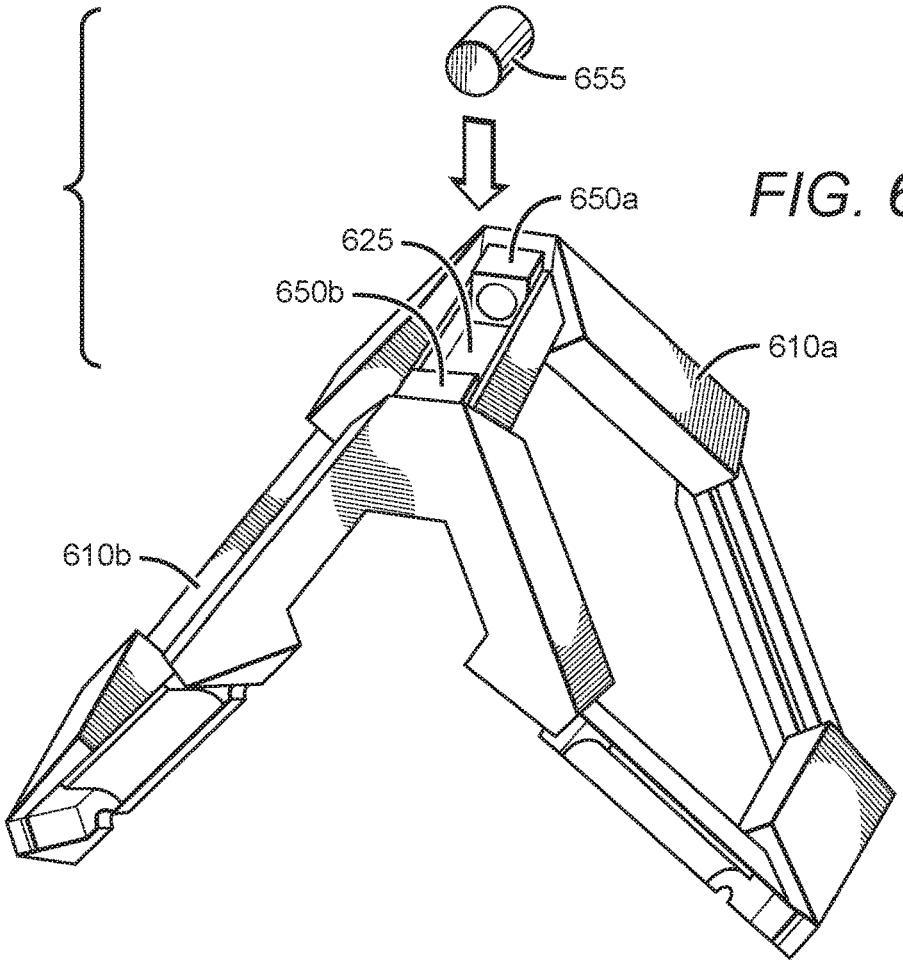
Figure 6G:
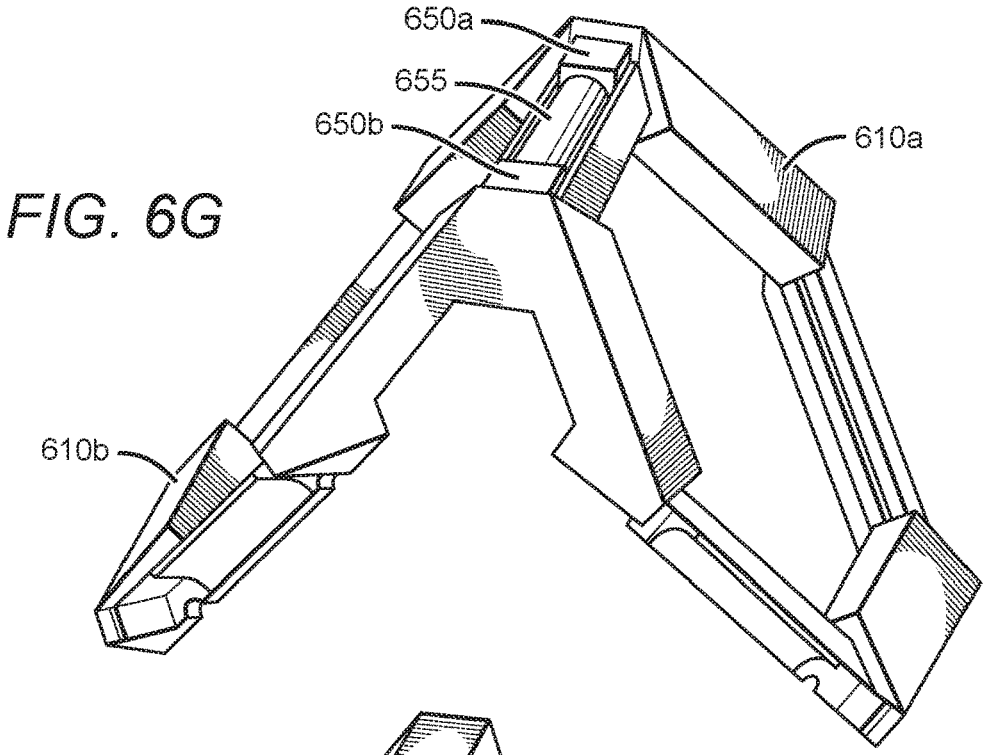
Figure 6H:
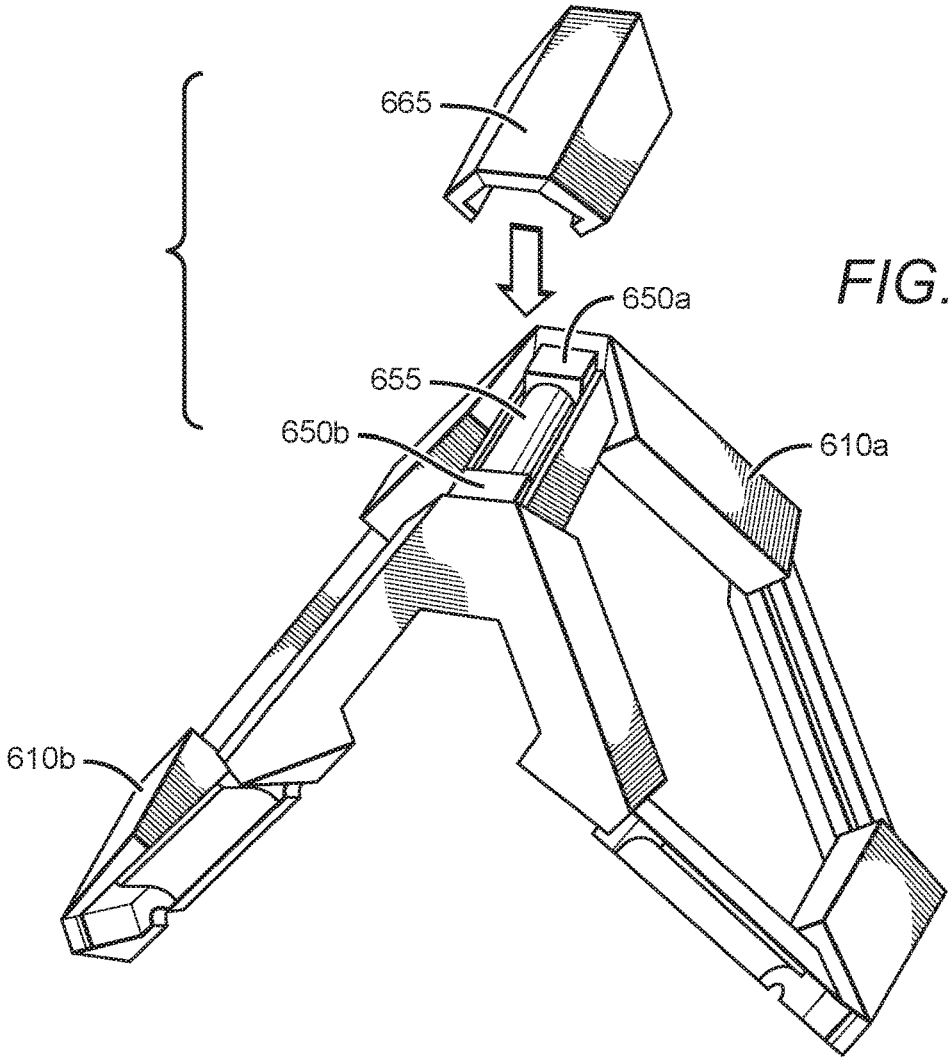

Once bumpers 650*a* and 650*b* are secured in place, magnet 655 could optionally be positioned between bumpers 650*a* and 650*b*, which allows frame 600 to removably couple with or attach to other frames having a suitable fastener (as shown in FIGS. 6F-6G), for example another magnet, or a metal clip. Clip 665 could be placed over seat 625, bumpers 650*a*, 650*b* and magnet 655, and snapped into place over seat 625, bumpers 650*a* and 650*b*, and magnet 655 (as shown in FIGS. 6H-6I) to form an edge strut or edge covering portion 680. The edge strut could be sized and dimensioned to be positioned over at least 50%, at least 60%, at least 70%, at least 80% or even more of an edge (e.g., a chamfered edge) of the geometric solid. Each of the frame panels of frame 600 could be coupled to one another in the same way as described above with respect to frame panels 610*a* and 610*b*.

FIG. 7 illustrates a plurality of modular frames coupled to one another at frame connection points (e.g., 770). Each frame connection point includes edge struts from two or more frames, each of which could include a magnet fastener positioned between a clip extending over arms of two or more frame panels, and a seat formed by the arms of the two frame panels. As illustrated, frame 700 is removably attached to frames 710 and 760, frame 710 is removably attached to frames 700, 720 and 750, frame 720 is removably attached to frames 710 and 730, frame 730 is removably attached to frames 720, 740 and 750, frame 740 is removably attached to frames 730 and 760, frame 760 is removably attached to frames 700, 740 and 760. It should be appreciated that a frame of the inventive subject matter could removably attach to a frame via two magnets, or via a magnet and a material attracted to the magnet (e.g., a metal clip). It should also be appreciated that frames of the inventive subject matter could be removably coupled to one another via mechanical fasteners such as clasps and catches. For example, some contemplated frames could be coupled using the fasteners of U.S. 2014/0072942, which is incorporated herein in its entirety.

Frames could be coupled with one another in an edge-to-edge, saddle-to-saddle, or edge-to-saddle configuration. Where an edge covering portion of a first frame couples with an edge covering portion of a second frame (via magnets positioned within the edge covering portions), the frames are coupled in an edge-to-edge configuration. Where an edge covering portion of a first frame couples with a vertex saddle portion of a second frame, the frames are coupled in an edge-to-saddle configuration. Where a vertex saddle portion of a first frame couples with a vertex saddle portion of a second frame, the frames are coupled in a saddle-to-saddle configuration. While the description above is largely directed to magnets positioned under clips and hidden from the user, it should be appreciated that magnetic fasteners could be positioned along any portion of a frame, including for example on an outer wall of a frame, or embedded in an arm or side of a frame panel.

Additionally or alternatively to coupling with one or more frames, a modular frame of the inventive subject matter could couple with a frame holder that is configured to hang on a necklace or other item of jewelry.

FIGS. 8A-8H illustrate an exemplary frame holder, which includes decorative features, provides additional protection to the geometric solid, and comprises an opening sized and dimensioned to allow a necklace to be threaded through and orient a frame and geometric solid in a desired manner Frame holder 800 includes a base 810 having an opening 830, a first base arm 820*a*, a second base arm 820*b* and a third base arm 820*c*. In the embodiment shown, each of the base arms extend away from base 810 at an angle relative to the base (e.g., between 25-85 degrees, between 25-65 degrees, between 35-55 degrees) such that the free ends of the base arms are positioned to align with opening 830. However, it should be appreciated that the base arms could extend away from the base at any suitable angle to accommodate the shape of a frame it receives. For example, a base arm could extend away from the base and at an obtuse angle (e.g., between 95-170 degrees, between 95-125 degrees) and then bend back towards the opening.

Base 810 could include an opening having ends 840*a* and 840*b*, and the opening could be sized and dimensioned to receive a necklace such that the frame holder could hang on the necklace when worn. In some preferred embodiments, the opening is positioned on the base such that when the necklace is worn and the frame holder hangs from the necklace, the base sits against the wearer's body, and the free ends of base arms 820*a*, 820*b* and 820*c* are positioned away from the wearer's body. More specifically, it is contemplated that in some embodiments the opening is positioned such that FIG. 8C illustrates a side of the base that would face the wearer, and FIG. 8F illustrates the side of the frame holder facing away from the wearer.

Figure 8A:
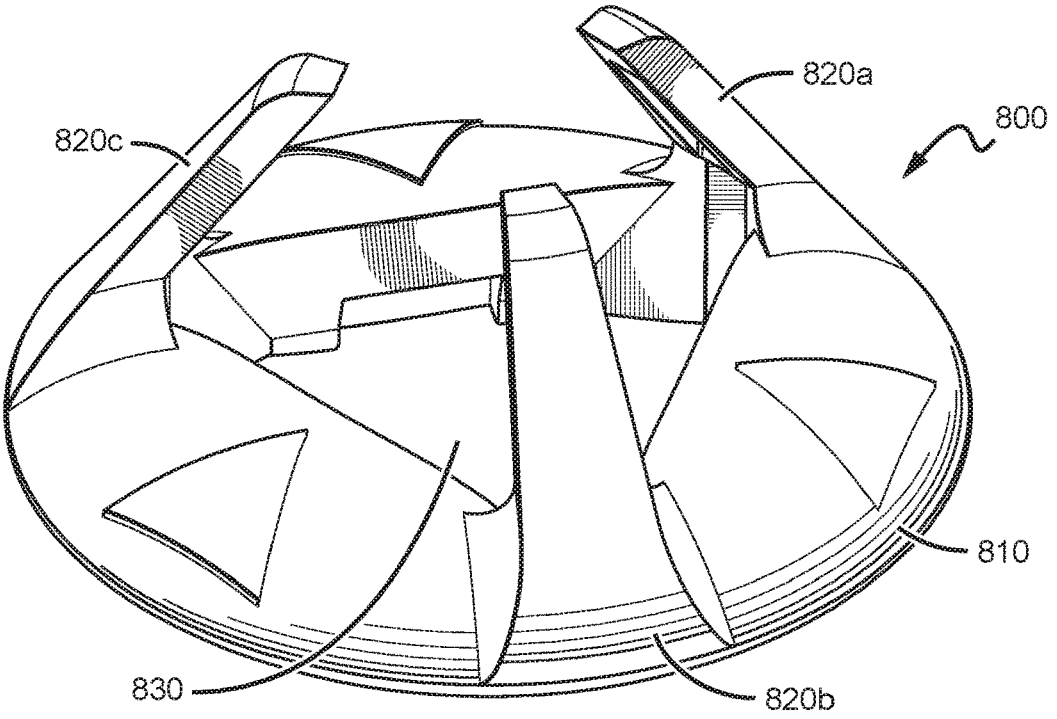
Figure 8B:
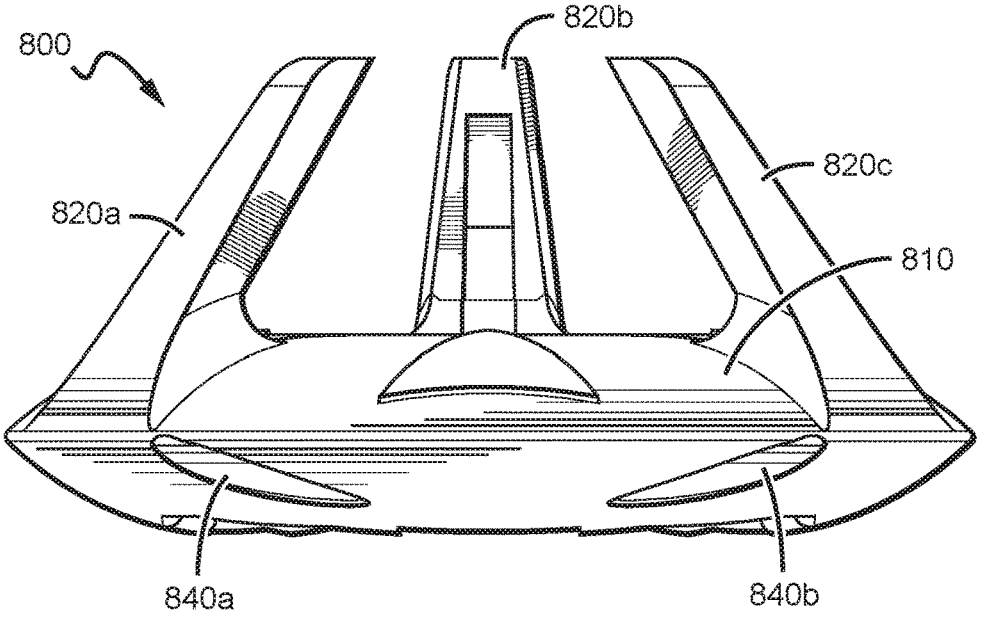
Figure 8G:
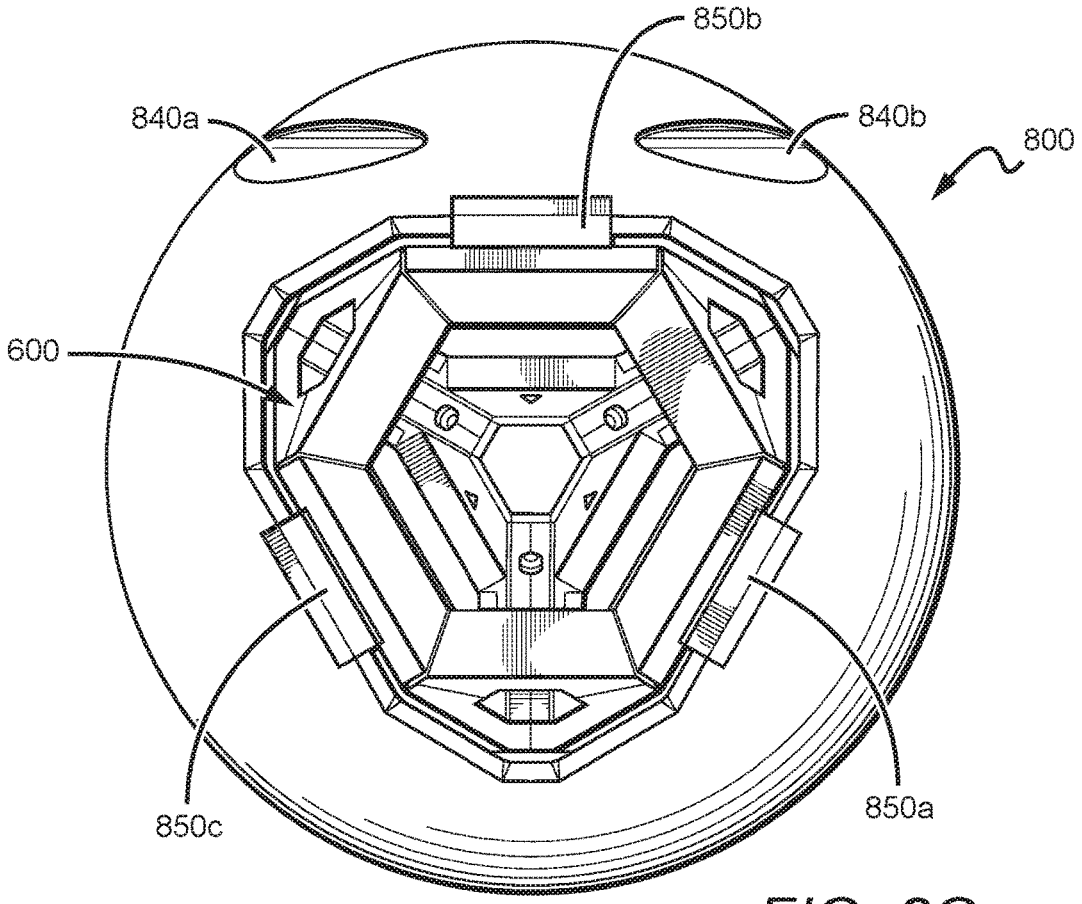
Figure 8H:
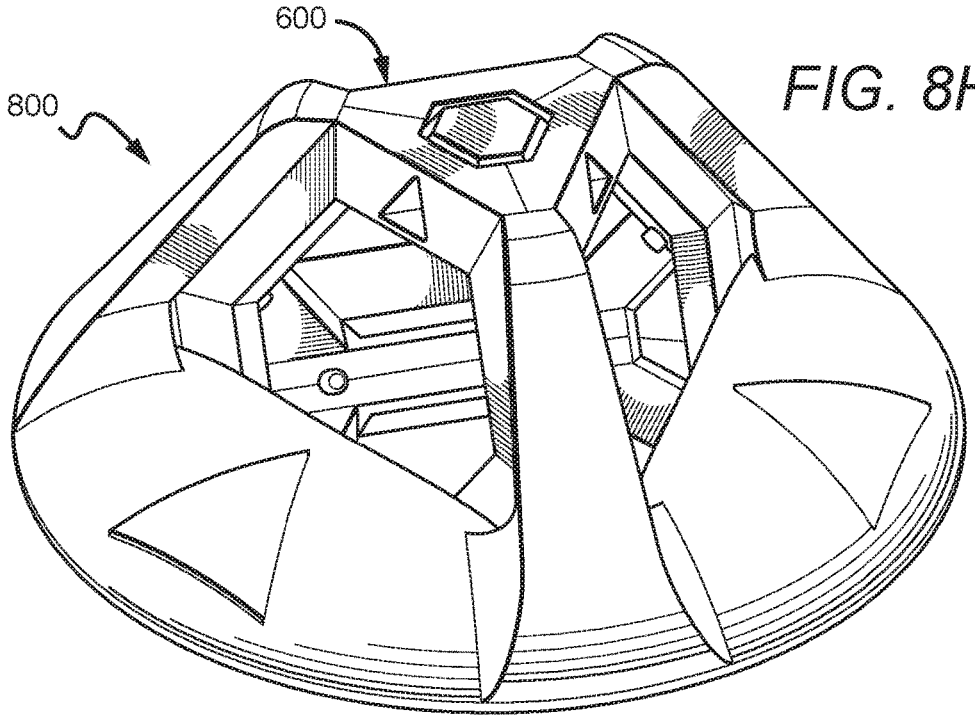

As best seen in FIGS. 8C and 8G, base 810 includes fasteners (e.g., fixed catches, movable catches) 850*a*, 850*b*, 850*c*, which are sized and dimensioned to releasably or permanently secure a frame (e.g., 600) in place between the opening 830 and base arms 820*a*, 820*b*, 820*c*. Additionally or alternatively, frame holder 800 could include magnetic fasteners (or a ferromagnetic or ferrous material) that are configured to couple with magnets of the frame 600. For example, base arms 820*a*, 820*b*, 820*c* could each enclose or otherwise include a magnet such that when frame is slid through opening 830, magnets of the edge covering portions fasten with magnets of base arms 820*a*, 820*b*, 820*c*. Once coupled to one another, frame 600 could be positioned relative to frame holder 800 such that base arms 820*a*, 820*b*, and 820*c* are positioned over the edge covering portions of frame 600, indicia on the frame (e.g., 215*a*) is visible and optionally aligned with indicia on the frame holder base, and at least a portion of at least one face of crystal 100 is visible.

The base and base arms could be made of any suitable material, and could be made of the same or different material(s) as a modular frame it is sized and dimensioned to receive. In some aspects, the entire frame holder could be made of an injection molded plastic. In other aspects, at least one of the base and the base arms could be made of a metal, a wood, a plastic, a glass, a rubber, or any other suitable material(s).

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Also, as used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A modular frame, comprising:

a first panel having (a) a first window, (b) a first mating edge having a first notch and a second notch, and (c) a first seat forming portion;

a second panel having (a) a second window, (b) a second mating edge having a first notch and a second notch, and (c) a second seat forming portion;

a first clip removably coupled to the first and second panels;

wherein the first mating edge abuts the second mating edge to thereby (a) align the first seat forming portion with the second seat forming portion to form a seat, (b) align the first notch of the first mating edge with the second notch of the second mating edge to form a first opening, and (c) align the second notch of the first mating edge with the first notch of the second mating edge to form a second opening;

a magnet disposed within the seat; and a first bumper having (a) a base, and (b) a protrusion inserted through the first opening.

2. The modular frame of claim 1, wherein the first clip includes a top and a side, and wherein the top has a greater length than the side.

3. The modular frame of claim 1, further comprising a second bumper, and wherein the first and second bumpers are positioned on opposite sides of the magnet.

4. The modular frame of claim 1, further a second bumper that includes a protrusion inserted through the second opening.

5. The modular frame of claim 1, wherein the first clip and the first and second panels are made from the same material.

6. The modular frame of claim 1, wherein at least one of the first clip and the first panel includes an indicia of an orientation of the geometric solid, and wherein the indicia is at least one of an etching, an alphanumeric character, an image, a logo, and an opening.

7. The modular frame of claim 1, further comprising third and fourth panels, and wherein the first, second, third and fourth panels couple to one another to form the modular frame, and wherein the modular frame is sized and dimensioned to hold a tetrahedron crystal.

8. The modular frame of claim 1, wherein the first opening has a hexagon shape.

9. The modular frame of claim 1, wherein the first panel is hexagonal.

10. The modular frame of claim 1, wherein the first window is hexagonal.

11. The modular frame of claim 1, wherein the first clip has a trapezoidal cross-section.

12. The modular frame of claim 1, wherein the first clip comprises first and second sides that each have a nook.

13. The modular frame of claim 1, wherein the protrusion comprises a compressible material.

14. The modular frame of claim 1, wherein the bumper comprises a foam, gel, or silicone material.

* * * * *